United States Patent [19]

Mizon et al.

[11] 3,943,691

[45] Mar. 16, 1976

[54] OPEN-END SPINNING APPARATUS

[75] Inventors: Eric Mizon, Rossendale; Hugh Moores, Oswaldtwistle, both of England

[73] Assignee: Platt International Limited, England

[22] Filed: Jan. 23, 1975

[21] Appl. No.: 543,302

[52] U.S. Cl. ..... 57/58.89

[51] Int. Cl.[2] ..... D01H 1/12

[58] Field of Search ..... 57/58.89–58.95

[56] References Cited

UNITED STATES PATENTS

| | | | |
|---|---|---|---|
| 3,520,122 | 7/1970 | Shepherd | 57/58.89 |
| 3,739,565 | 6/1973 | Magel | 57/58.89 |
| 3,812,667 | 5/1974 | Marsalek et al. | 57/58.89 |
| 3,822,541 | 7/1974 | Croasdale et al. | 57/58.89 |
| 3,837,154 | 9/1974 | Stahlecker | 57/58.89 |

*Primary Examiner*—Donald E. Watkins

*Attorney, Agent, or Firm*—Watson, Cole, Grindle & Watson

[57] ABSTRACT

An open-end spinning machine rotor is formed from sheet metal as an annular body. The body has an interior fibre collecting surface on which discrete fibres are continuously deposited and from which the tail end of a yarn is continuously drawn-off. The body is shaped to provide first and second portions converging to a region of maximum diameter at which is located the interior fibre collecting surface. In this way, the internal fibre collecting surface is free from surface imperfections which would adversely affect the operation of the rotor.

6 Claims, 6 Drawing Figures

OPEN-END SPINNING APPARATUS

BACKGROUND TO THE INVENTION

Figure 1:
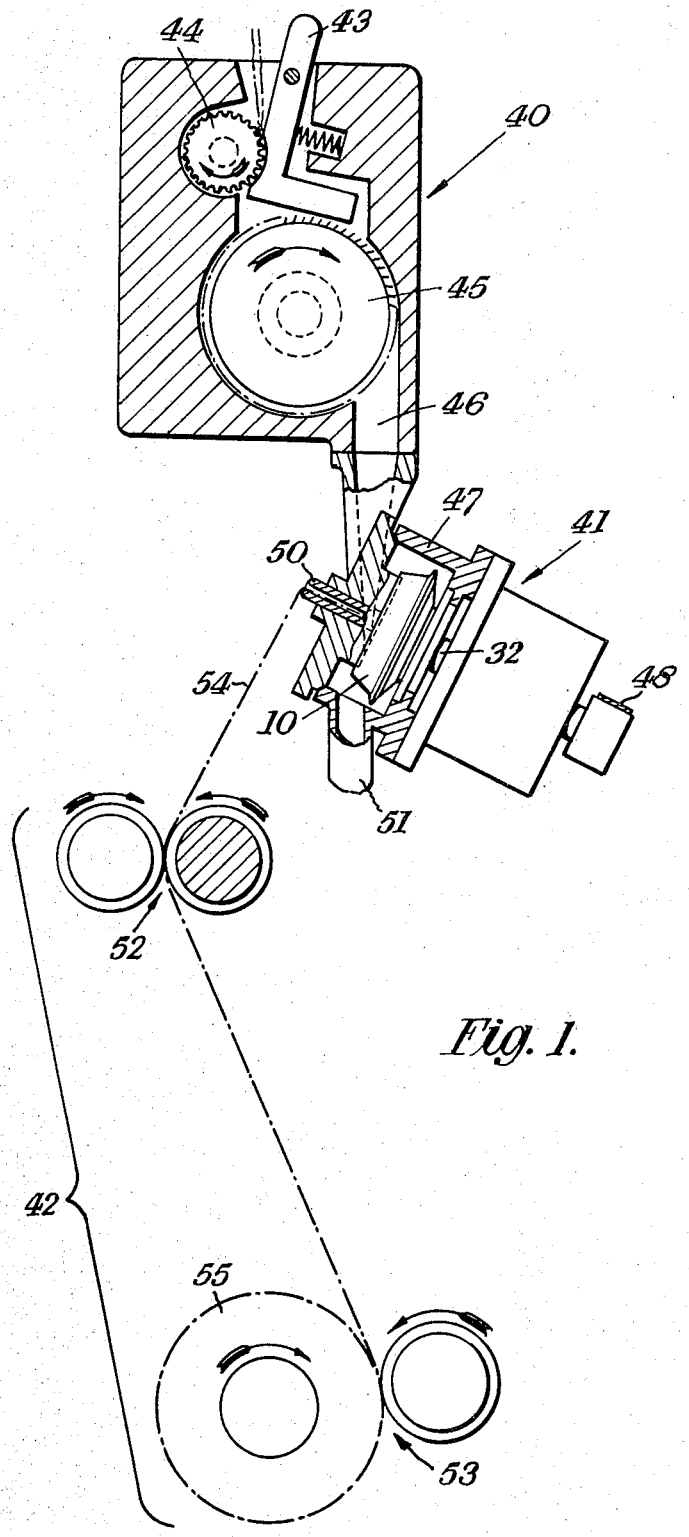

In open-end spinning machines of one previously proposed type, twisted yarn is formed by continuously depositing discrete fibres on an interior fibre-collecting surface of a spinning rotor, continuously removing them from the surface by twisting them into a tail end of a yarn formed thereby, and drawing off the continuously formed twisted yarn.

Spinning rotors for apparatus of this type have hitherto been formed as a hollow body of revolution about the rotary axis, with an inner surface which comprises two coaxial frusto-conical portions joined together at their regions of maximum diameter to provide an axially localised fibre collecting surface on which the discrete fibres are deposited and compacted before being twisted into the tail end of yarn and drawn off as twisted yarn.

Previously, such spinning rotors have been turned on a lathe from a solid piece of material and, due to the internal and external faces of the rotor being non-cylindrical, there have been difficulties regarding machining. It will be appreciated that by using a solid piece of material for manufacture, operations become costly and time consuming. Furthermore, there is the disadvantage that cutting marks are caused by the lathe tool and may have to be removed by further machining.

When using material in cast form for the spinning rotor there is the disadvantage that defects such as cracks or blow holes are present within the material. These defects may cause imperfections in the surface of the rotor and also when a spinning rotor is rotated at very high speeds, there is some danger of fracture of the rotor. Furthermore, cast rotors are usually relatively heavy and tend to accentuate the problems encountered when rotating a body at high speeds, such for example as those created by out-of-balance loads, excessive bearing wear, high power consumption required to drive the rotor and high braking energy required to stop the rotor.

In addition, the cutting marks caused by the lathe tool in forming the internal surfaces of the spinning rotor are a contributory factor to rotor wear when under the abrasive action of the fibres within the rotor. Similarly, when using material in cast form for the spinning rotor, the surface defects such as cracks or blow holes also contribute toward rotor wear under the abrasive action of the fibres within the rotor.

SUMMARY OF THE INVENTION

An object of the present invention is to provide an open-end spinning rotor in which the disadvantages referred to above are eliminated or reduced.

It is a further object of the invention to provide an open-end spinning rotor in which the interior surface of the rotor does not have the roughness left by machining processes.

It is another object to provide a rotor free from internal cracks or blow holes.

Yet another object of the invention is to provide a rotor of light weight thus minimising problems created by out of balance loads at high rotational speeds.

Another object of the invention is to provide a rotor which is inexpensive to manufacture which is easily constructed and yet is strong and satisfactory in operation.

The objects are achieved by the invention which provides an open-end spinning machine comprising fibre feed means, yarn delivery means, a rotatable rotor formed by deformation of sheet metal, first and second portions of the rotor which converge to a region of maximum diameter, an interior fibre collecting surface, formed at the region of maximum diameter, on which discrete fibres are continuously deposited by the fibre feed means and from which the tail end of a yarn is continuously drawn off by the yarn delivery means whereby the sheet metal interior fibre collecting surface of the rotor is smooth and free from surface imperfections which would adversely affect the operation of the rotor.

The construction of open-end spinning machines according to the invention, has many advantages. The use of sheet metal gives a smooth fibre collecting surface and thus prevents fibres catching on the surface. There is no wastage of material by machining and the light weight of the rotor decreases motor and bearing loads, thus increasing the life of these components.

The surface of the rotor is resistant to wear and strong due to the absence of the blow holes and cracks commonly present in cast materials. Manufacturing is inexpensive and can be used to produce rotors rapidly.

Figure 2:
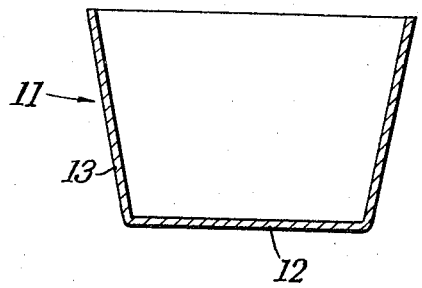
Figure 3:
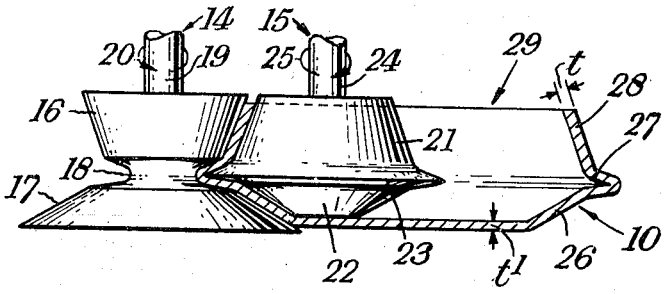
Figure 4:
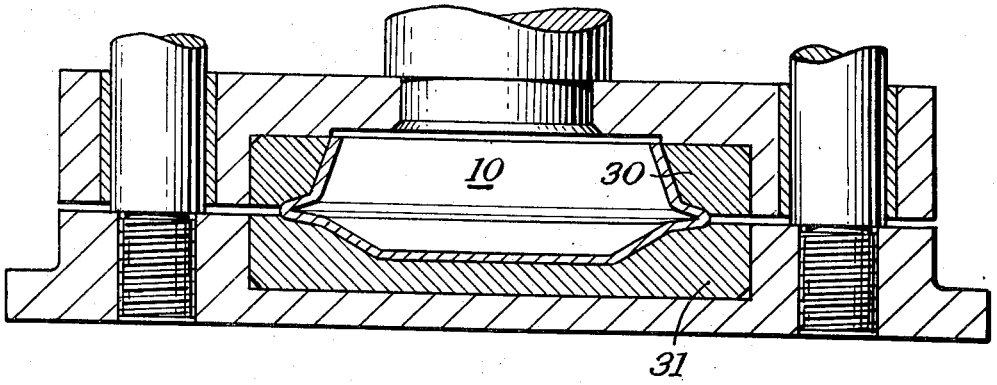
Figure 5:
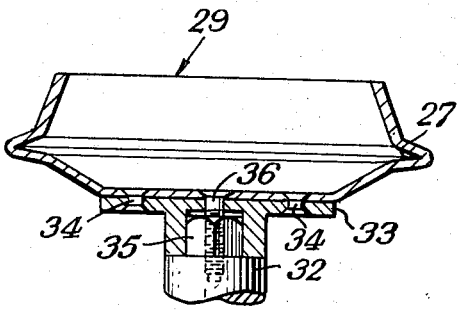

The following is a more detailed description of one embodiment of the invention, by way of example, reference being made to the accompanying drawings in which:

FIG. 1 shows an open-end spinning machine,

FIG. 2 shows a cross-sectional view of a sheet metal blank from which a rotor of the open-end spinning machine is constructed, FIG. 3 shows a cross-sectional view of the rotor during a swaging operation, FIG. 4 shows a cross-sectional view of the rotor being corrected for concentricity and FIG. 5 shows a partial cross-sectional view of a completed rotor mounted for use in the open-end spinning machine.

Figure 6:
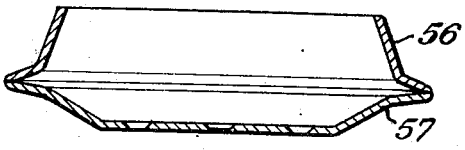

FIG. 6 shows an alternative form of rotor for the open-end spinning machine of FIG. 1.

Referring first to FIG. 1, the open-end spinning machine comprises a fibre feed device 40, a rotor assembly 41 and a yarn delivery arrangement 42. The fibre feed device 40 comprises an L-shaped feed pedal 43 having one arm co-operating with a feed roller 44, and the other arm co-operating with an opening roller 45. A fibre feed duct 46 leads from the opening roller 45 to the rotor assembly 41.

The rotor assembly 41 comprises an outer casing 47 in which is mounted a rotor 10, of a kind to be described hereinafter, on a drive shaft 32 rotated by a belt drive 48. The casing 47 has a removable cover 49 through which extends a yarn delivery tube 50 and the fibre feed duct 46, both of which terminate within the casing 47 adjacent the open end of the rotor 10. A duct 51 exhausts air from the casing 47.

The delivery arrangement comprises a pair of delivery rollers 52 and a wind-up device 53.

In use, fibres pass between the pedal 43 and the feed roller 44 to the opening roller 45 and are opened thereby so that discrete fibres are fed along the fibre feed duct 46 and on to the interior surface of the rotor 10, which is constructed in a manner hereinafter described. The rotor 10 is rotated by the drive belt 48 and the tail-end of a spun yarn 54 is drawn off through the delivery tube 50 by the delivery rollers 52. The yarn is then wound up into a package 55.

Referring next to FIG. 2, the rotor is constructed from a cup-shaped metal blank 11 of uniform thickness, having a base 12 and an annular wall 13 surrounding the base and increasing in diameter as it extends away from the base. The blank 11 may be constructed from a flat sheet of duralumin of 10 s.w.g. by a punching operation in a power press and a deep drawing operation in a hydraulic press. Alternatively, sheet brass, sheet stainless steel or sheet mild steel may be used and the thickness of the sheet may be between 10 s.w.g. and 20 s.w.g.

Referring additionally to FIG. 3, the blank 11 is subjected to a swaging process by two complementary shaped swaging wheels 14, 15. The generally concave swaging wheel 14 is formed with an upper frusto-conical portion 16 and a lower frusto-conical portion 17 which both decrease in diameter towards a central annular groove 18. The concave swaging wheel 14 is rotated by a shaft 19 in the direction indicated by the arrow 20.

The generally convex swaging wheel 15 comprises an upper frusto-conical portion 21 and a lower frusto-conical portion 22 increasing in diameter towards a central annular ridge 23. The dimensions of the frusto-conical portions 21, 22 and the ridge 23 are such that they are a complementary fit with the frusto-conical portions 16, 17 and the groove 18 of the concave swaging wheel 14, as seen in FIG. 2. The convex swaging wheel 15 is rotated by a shaft 24 in a direction, indicated by the arrow 25, which is opposite to the direction of rotation of the concave swaging wheel 14.

The metal blank 11 is held between the concave swaging wheel 14 and the convex swaging wheel 15 during the swaging process. The wall 13 is reduced in height and formed into an annular hollow body with a lower frusto-conical wall portion 26 extending outwardly from the base 12 to an external annular rib 37 and a corresponding annular groove 27 which forms the maximum diameter portion of the rotor 10, and then forms an upper frusto-conical wall portion 28 which reduces in diameter towards the open-end 29 of the rotor 10.

The swaging process has the effect of increasing the thickness $t$ of the upper frusto-conical portion 28 by a small amount in relation to the thickness $t'$ of the remainder of the rotor 10, thus increasing its strength.

Turning next to FIG. 4, once the swaging process is complete the rotor 10 is corrected for roundness by two dies, an upper die 30 and a lower die 31. The upper die 30 includes an aperture which is shaped to the desired shape and concentricity of the upper portion of the rotor 10. The lower die 31 is formed with a recess which is shaped to correspond to the desired shape and concentricity of the lower portion of the rotor 10. The two dies 30, 31 are pressed together to constrain the dimensions of the rotor 10 into perfect concentricity about a vertical axis.

After the rotor 10 has been corrected for roundness, it forms a finished rotor 10. Referring next to FIG. 5, the rotor 10 is mounted in the open-end spinning machine of FIG. 1 with the base 12 connected to a carrier plate 33 by rivets 34. The carrier plate 33 is mounted on the drive shaft 32 by means of a spigot 35 and a screw 36. It will be appreciated that other means of securing the rotor to the shaft could be employed.

In use, the shaft 32 is rotated at speeds of the order of 45,000 r.p.m. by the drive belt 48 (see FIG. 1). The groove 27 provides an interior fibre collecting surface on which, in use, discrete fibres are continuously deposited through the open-end 29 of the rotor 10 by the fibre feed device 40 (FIG. 1). It will be appreciated that the formation of the rib 37 and groove 27, and the stiffening of the upper frusto-conical portion 28 will both increase the strength of the rotor 10. Thus the resistance of the rotor to deformation at high rotational speeds will be increased since the maximum deformational stresses on the rotor are at the open-end 29 and the groove 27.

It will also be appreciated that the profile of the rotor shown in FIG. 2 may be obtained by a spinning operation or fluid forming or explosive forming rather than by swaging. The rotor may also be formed from a plurality of annular sections, for example, two annular sections 56, 57 as shown in FIG. 6, the sections each being frusto-conical in shape with the diameter of the maximum diameter end of each frustum being the same. Thus the two maximum diameter ends can be connected together to form the rotor.

Spinning rotors formed in accordance with the present invention have fibre contacting surfaces of superior finish free from defects which have been inherent in rotors manufactured from a solid piece of material. This improved surface finish has provided the rotor with an improved fibre processing surface having an increased resistance to wear under the action of the fibres during operation. The reduction in weight of the rotor as compared with former rotors enables it to be used satisfactorily for high-speed operation.

We claim:

1. An open-end spinning machine comprising fibre feed means, yarn delivery means, a rotatable rotor formed by deformation of sheet metal, first and second portions of the rotor which converge to a region of maximum diameter, an interior fibre collecting surface formed at the region of maximum diameter on which discrete fibres are continuously deposited by the fibre feed means and from which the tail end of a yarn is continuously drawn off by the yarn delivery means whereby the sheet metal interior fibre collecting surface of the rotor is smooth and free from surface imperfections which would adversely affect the operation of the rotor.

2. A machine according to claim 1 wherein the rotor comprises an external annular rib and a corresponding internal annular groove so constructed and arranged as to increase the strength of the rotor.

3. A machine according to claim 1 wherein the rotor comprises a fibre inlet opening at one end and an annular portion adjacent said opening of increased thickness compared with the remainder of the rotor so that said portion of the hollow body is of increased strength.

4. A machine according to claim 1 wherein the rotor comprises a plurality of annular sections formed from sheet material.

5. A machine according to claim 4 wherein the plurality of annular sections comprise two annular sections each of the sections being substantially frusto-conical in shape with the diameter of the maximum diameter end of each section being the same, the two maximum diameter ends being connected together to form the rotor.

6. A machine according to claim 1 wherein the sheet metal from which the rotor is constructed has a thickness in the range 10 s.w.g. to 20 s.w.g.

* * * * *